US009068528B2

(12) United States Patent
Sanbyakuda et al.

(10) Patent No.: US 9,068,528 B2
(45) Date of Patent: Jun. 30, 2015

(54) METHOD AND DEVICE FOR MOUNTING CAM ANGLE SENSOR FOR INTERNAL COMBUSTION ENGINE

(75) Inventors: Wataru Sanbyakuda, Ikeda (JP); Kunihiko Ohkubo, Osaka (JP); Hideyuki Kou, Ikeda (JP); Eiichi Komatsu, Ikeda (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 520 days.

(21) Appl. No.: 13/000,474

(22) PCT Filed: Jun. 12, 2009

(86) PCT No.: PCT/JP2009/060769

§ 371 (c)(1),
(2), (4) Date: Feb. 11, 2011

(87) PCT Pub. No.: WO2009/157323

PCT Pub. Date: Dec. 30, 2009

(65) Prior Publication Data

US 2011/0119915 A1 May 26, 2011

(30) Foreign Application Priority Data

Jun. 23, 2008 (JP) ..... 2008-162995

(51) Int. Cl.
*F01L 1/04* (2006.01)
*F02F 7/00* (2006.01)
(Continued)

(52) U.S. Cl.
CPC ..... *F02F 7/006* (2013.01); *Y10T 29/49233* (2015.01); *Y10T 29/53* (2015.01); *F01L 1/047* (2013.01); *F01L 1/053* (2013.01); *F01L 2001/0476* (2013.01); *F01L 2820/041* (2013.01)

(58) Field of Classification Search
CPC ..... F01L 1/04
USPC ..... 73/118.1, 118.01, 118.02; 123/90.15, 123/90.38, 184.21, 198 E; 29/888.01, 29/888.03
See application file for complete search history.

(56) References Cited

U.S. PATENT DOCUMENTS 5,948,973 A 9/1999 Fujii et al.
6,679,107 B1 1/2004 Ono et al.
(Continued)

FOREIGN PATENT DOCUMENTS

JP 8 68346 3/1996
JP 9 280084 10/1997
(Continued)

OTHER PUBLICATIONS

Kichijima, Aug. 2006, JP 2006 220073 Machine Translation.*
(Continued)

*Primary Examiner* — Alexander P Taousakis
*Assistant Examiner* — Lee A Holly
(74) *Attorney, Agent, or Firm* — Oblon, McClelland, Maier & Neustadt, L.L.P.

(57) ABSTRACT

In an internal combustion engine in which a head cover for covering a cam shaft at an upper face of a cylinder head is made of a synthetic resin, a cam angle sensor for the cam shaft is securely attached to the cylinder head such that heat damage to the cam angle sensor is suppressed. The cam angle sensor is inserted in a through-hole perforated through the head cover, and a mounting portion integral with the cam angle sensor is fastened to a member of the cylinder head, with fixing members penetrating through the head cover on a side of the cam angle sensor.

8 Claims, 3 Drawing Sheets

(51) Int. Cl.
*F01L 1/047* (2006.01)
*F01L 1/053* (2006.01)

(56) References Cited

U.S. PATENT DOCUMENTS

| | | | | |
|---|---|---|---|---|
| 7,343,889 | B2 * | 3/2008 | Tooyama et al. | 123/90.38 |
| 2001/0042527 | A1 * | 11/2001 | Uchida | 123/90.15 |
| 2007/0017282 | A1 | 1/2007 | Tooyama et al. | |
| 2008/0121477 | A1 * | 5/2008 | Bianchi | 188/273 |

FOREIGN PATENT DOCUMENTS

| | | | |
|---|---|---|---|
| JP | H 11-257124 | | 9/1999 |
| JP | 2006 220073 | | 8/2006 |
| JP | 2006220073 | A * | 8/2006 |
| JP | 2007 32309 | | 2/2007 |
| JP | 2007032309 | A * | 2/2007 |
| JP | 2007 107387 | | 4/2007 |
| JP | 2007107387 | A * | 4/2007 |
| JP | 2009 167809 | | 7/2009 |
| WO | WO 2006/085640 | | 8/2006 |

OTHER PUBLICATIONS

Emi, Apr. 2007, JP 2007 107387 Machine Translation.*

International Search Report issued Aug. 11, 2009 in PCT/JP09/060769 filed Jun. 12, 2009.

* cited by examiner

METHOD AND DEVICE FOR MOUNTING CAM ANGLE SENSOR FOR INTERNAL COMBUSTION ENGINE

FIELD OF THE DISCLOSURE

The present invention relates to a method and a device for mounting a cam angle sensor in an internal combustion engine.

BACKGROUND OF THE DISCLOSURE

Generally, in an internal combustion engine in which the valve timing of an intake valve or an exhaust valve is variable, it is necessary to constantly detect, by using a cam aperture sensor, the cam angle of a cam shaft that opens or closes the intake valve or the exhaust valve.

Patent document 1, as prior art, proposes mounting a cam shaft angle sensor to a member of a cylinder head, rather than to a head cover for covering the upper face of the cylinder head.

Specifically, a mounting portion is formed integral with a member of the cylinder head, such as a bearing cap that pivotally supports the upper half of the cam shaft, in a manner such that the mounting portion penetrates through the head cover to project beyond the upper side of the head cover. The angle sensor is removably attached to the mounting portion by being fitted into a mounting hole made in the mounting portion and fastened with a bolt.

Patent document 1: JP-A-2006-220073

SUMMARY OF THE DISCLOSURE

Problem to be Solved by the Invention

In accordance with the conventional mounting structure, the angle sensor can be securely supported, without being affected by vibration or deformation occurring at the head cover.

However, the angle sensor, as stated above, is fitted and bolted in the mounting hole in the mounting portion, which is an integral part of the bearing cap. Thus, the heat generated on the part of the cylinder head is readily conducted to the angle sensor. Accordingly, the angle sensor can be unduly damaged by the heat from the cylinder head.

It is therefore a technical object of the present invention to provide a mounting method and device capable of overcoming the problem noted above.

To accomplish the technical object, a method according to the present invention comprises: inserting a cam angle sensor into a through-hole perforated through a head cover made of a synthetic resin for covering an upper face of a cylinder head, the cam angle sensor being provided for a cam shaft at the upper face of the cylinder head; and fastening a mounting portion integral with the cam angle sensor to a member of the cylinder head by using a fixing member penetrating through the head cover.

In one aspect of the method, the fixing member fastens simultaneously, to the member of the cylinder head, both the mounting portion of the cam angle sensor and a portion of the head cover through which the fixing member penetrates.

In one aspect of the method, a collar made of a metal is disposed at the portion of the head cover through which the fixing member penetrates in such a manner that the collar abuts the mounting portion of the cam angle sensor and the member of the cylinder head.

A device according to the present invention is configured such that, in an internal combustion engine in which a head cover for covering a cam shaft at an upper face of a cylinder head is made of a synthetic resin, the cam angle sensor for the cam shaft is inserted in a through-hole perforated in the head cover, and a mounting portion integral with the cam angle sensor is fastened to a member of the cylinder head by using a fixing member penetrating through the head cover.

In one aspect of the device, the fixing member fastens simultaneously, to the member of the cylinder head, both the mounting portion of the cam angle sensor and a portion of the head cover through which the fixing member penetrates.

In one aspect of the device, a collar made of a metal is disposed at the portion of the head cover through which the fixing member penetrates in such a manner that the collar abuts the mounting portion of the cam angle sensor and the member of the cylinder head.

The cam angle sensor is securely fastened to the member of the cylinder head by using the fixing member penetrating through the head cover. On the other hand, with respect to the head cover, the cam angle sensor is merely inserted in the through-hole provided in the head cover made of a synthetic resin. This arrangement ensures that the cam angle sensor is securely mounted to the cylinder head while heat transmission from the cylinder head to the cam angle sensor is significantly suppressed as compared with the conventional structure in which the cam angle sensor is inserted in a mounting hole provided on the cylinder head side.

In this way, the cam angle sensor is effectively kept from suffering the heat damage originating from the cylinder head.

Further, at the same time as mounting the cam angle sensor, the portion of the head cover close to the cam angle sensor is supported on the cylinder head in such a manner that vibration at this portion is suppressed.

In addition, the collar made of a metal reinforces the fastening of the cam angle sensor to the member of the cylinder head.

REFERENCE SIGNS

Figure 1:
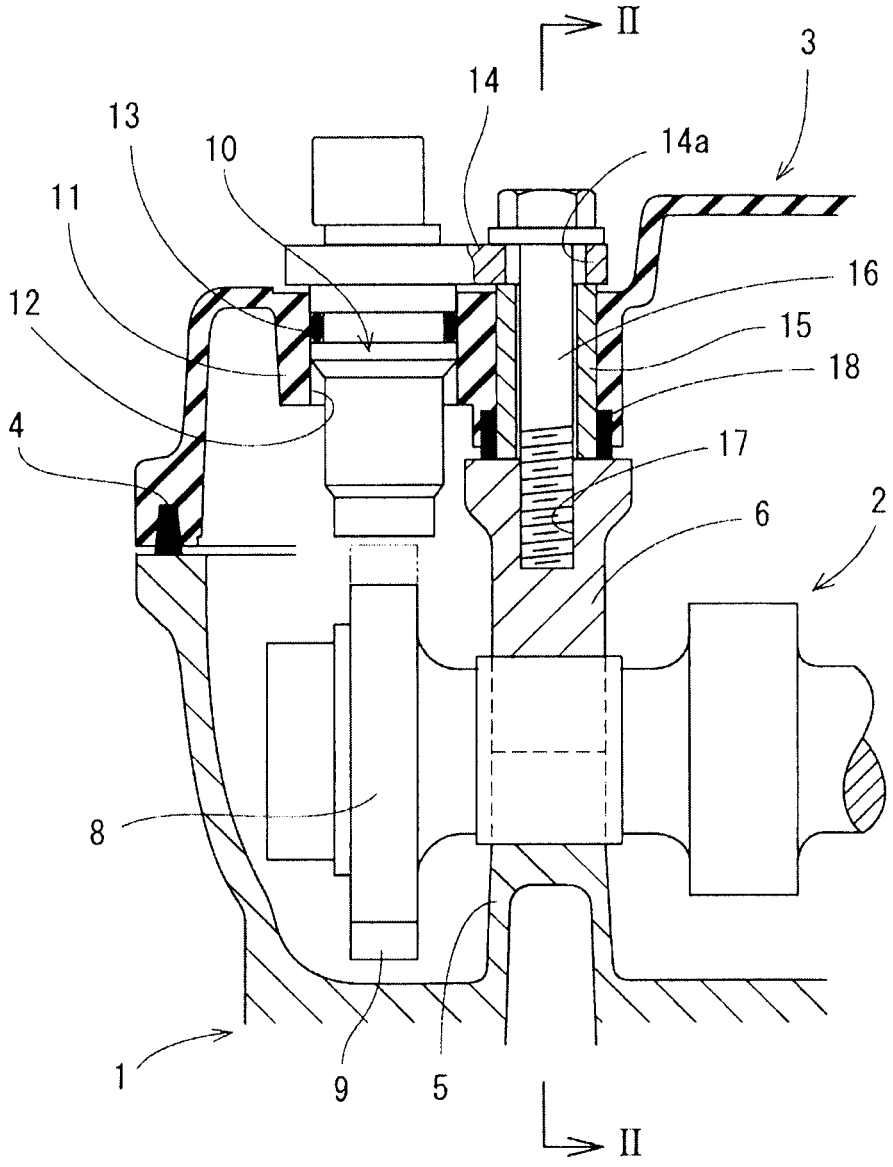
FIG. 1 is a vertical cross-sectional front view showing an embodiment of the present invention.

1 cylinder head
2 cam shaft
3 head cover
5 bearing portion
6 bearing cap
8 rotor
10 cam angle sensor
11 boss
12 through-hole
14 mounting portion
15 collar
16 fastening bolt

DETAILED DESCRIPTION OF THE PREFERRED EMBODIMENTS

Figure 2:
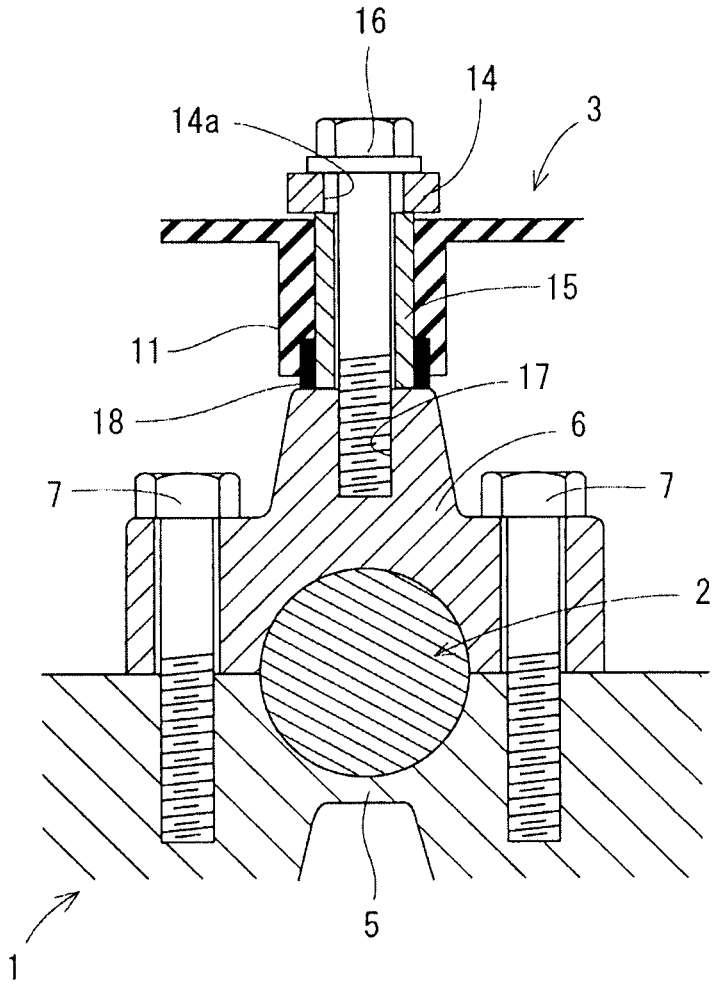
FIG. 2 is a sectional view taken along lines II-II in FIG. 1.
Figure 3:
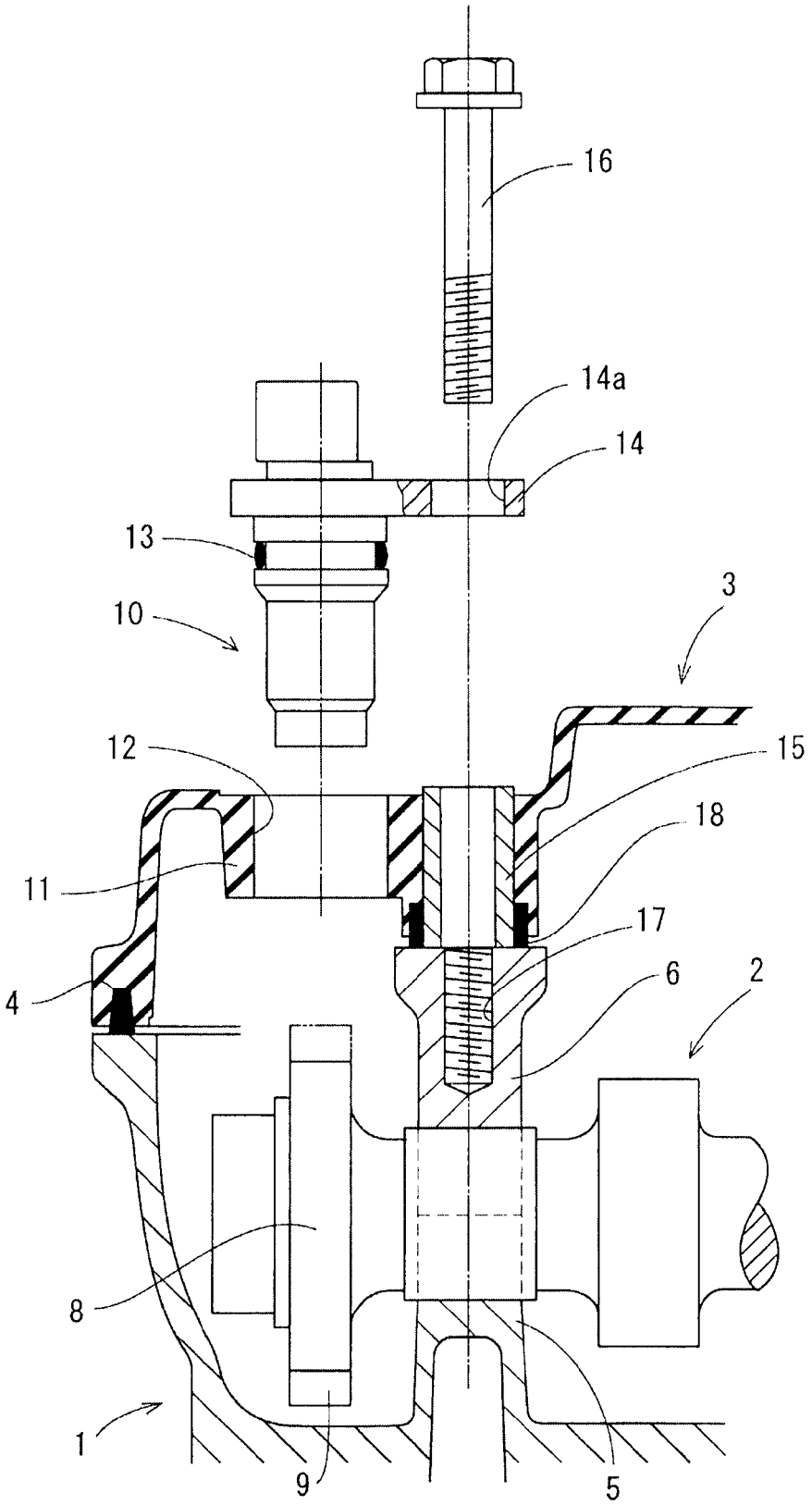
FIG. 3 is an exploded view.

Embodiments of the present invention will be described below with reference to FIGS. 1 to 3.

In these figures, indicated by reference sign 1 is a cylinder head of an internal combustion engine. A head cover 3 made of a synthetic resin is disposed above the upper face of the cylinder head 1 so as to cover a cam shaft 2 pivotally supported on the upper face of the cylinder head. As conventionally known, the head cover 3 is removably attached to the cylinder head 1 by fastening bolts (not shown), which are disposed at and penetrate through the periphery of the head cover. With the bolts tightened, a seal member 4 disposed under the periphery of the head cover is compressed.

The cam shaft 2 on the upper face of the cylinder head 1 is rotatably supported by a bearing portion 5, formed integral with the cylinder head 1, and a bearing cap 6 which is fastened to the bearing portion 5 with a pair of bolts 7 for the right and left sides of the cap. The cam shaft 2 is provided with a rotor 8 adjacent to the bearing portion 5 and the bearing cap 6, where the rotor has projections 9 at phase positions where an intake valve or an exhaust valve is opened or closed.

Indicated by reference sign 10 is a cam angle sensor. The cam angle sensor 10 is inserted in a through-hole 12 in a boss 11 integrally formed in the synthetic resin head cover 3, such that an end of the cam angle sensor 10 can face the projections 9 of the rotor 8 of the cam shaft 2. The cam angle sensor 10 is provided with a seal ring 13 around the outer circumferential surface, so that the seal ring is held in close contact with the inner circumferential surface of the through-hole 12.

The cam angle sensor 10 is integrally provided with a mounting portion 14 at a position outside of the head cover 3.

In the boss 11 of the head cover 3, a collar 15 made of a metal is fixed so as to penetrate through the boss 11 at a position right above the bearing cap 6. The lower end of the collar 15 abuts the upper face of the bearing cap 6, while the upper end of the collar 15 abuts the lower face of the mounting portion 14 of the cam angle sensor 10.

A headed fastening bolt 16 is inserted in the collar 15 through a bolt hole 14*a* perforated in the mounting portion 14. The lower end of the fastening bolt 16 is screw-engaged with a female thread 17 formed in the bearing cap 6 of the cylinder head 1, so that the fastening bolt 16 is tightened. A seal member 18 having a ring shape surrounding the outer circumference of the collar 15 is provided between the lower face of the boss 11 of the head cover 3 and the upper face of the bearing cap 6.

In the above-described structure, the cam angle sensor can be securely mounted to the bearing cap 6 of the cylinder head 1, via the metal collar 15, by tightening the fastening bolt 16. Also, the boss 11 of the head cover 3 and further a portion close to the cam angle sensor 10 can be pressed against the bearing cap 6 of the cylinder head 1, so that these portions are properly supported with suppressed vibration.

In addition, the cam angle sensor 10 is simply inserted in the through-hole 12 of the head cover 3 made of a synthetic resin. Thus, heat transmission from the cylinder head 1 to the cam angle sensor 10 is effectively suppressed.

In the foregoing embodiment, the bearing cap 6 for pivotally supporting the upper half of the cam shaft 2 is used, among members of the cylinder head, for mounting the bearing cap 6. The present invention, however, is not limited to such a configuration. Another member formed integral with the cylinder head 1 (for example, the bearing portion 5) or a separate member attached to the cylinder head 1 may be adopted as "the member of the cylinder head" in the claims below for mounting the cam angle sensor 10.

The invention claimed is:

1. A mounting device of a cam angle sensor in an internal combustion engine in which a head cover for covering a cam shaft at an upper face of a cylinder head is made of a synthetic resin, wherein the cam angle sensor is inserted in a through-hole perforated in the head cover, the cam angle sensor being arranged to face an outer periphery of a rotor on the cam shaft for detection of cam angles, wherein a mounting portion is integrally formed with the cam angle sensor at a position outside of the head cover, the mounting portion of the cam angle sensor being fastened to a bearing cap by a fixing member penetrating through the head cover at a position adjacent to a position of the cam angle sensor, the bearing cap pivotally supporting the cam shaft at a position adjacent to a position of the rotor, wherein the fixing member fastens simultaneously, to the bearing cap, both the mounting portion of the cam angle sensor and a portion of the head cover through which the fixing member penetrates.

2. The mounting device according to claim 1, wherein a collar made of a metal is disposed at a location in the head cover through which the fixing member penetrates in such a manner that the collar abuts the mounting portion of the cam angle sensor and the bearing cap.

3. The mounting device according to claim 1, wherein the mounting portion is located at the position outside of the head cover, and wherein the mounting portion abuts an upper end of a collar located at the portion of the head cover through which the fixing member penetrates.

4. The mounting device according to claim 1, wherein the mounting portion is fastened to the bearing cap at the upper face of the cylinder head by the fixing member penetrating through the head cover at the position adjacent to the position of cam angle sensor.

5. The mounting device according to claim 1, wherein the mounting portion is fastened to the bearing cap by the fixing member penetrating through the head cover and the mounting portion.

6. The mounting device according to claim 5, wherein the fixing member penetrates the mounting portion and the head cover in a location adjacent to the through-hole to engage a female thread in the bearing cap, and fastens the cam angle sensor and the head cover to the cylinder head.

7. The mounting device according to claim 5, wherein the mounting portion includes a mounting hole, the mounting portion being located at the position outside of the head cover, wherein the head cover includes a hole adjacent to the through-hole, wherein the bearing cap is provided at the upper face of the cylinder head, and wherein the fixing member penetrates through the mounting hole and the hole adjacent to the through-hole, and engages a female thread of the bearing cap to fasten the cam angle sensor to the head cover, and fasten the cam angle sensor and the head cover to the cylinder head.

8. A mounting device of a cam angle sensor in an internal combustion engine in which a head cover for covering a cam shaft at an upper face of a cylinder head is made of a synthetic resin, wherein the cam angle sensor is inserted in a through-hole perforated in the head cover, the cam angle sensor being arranged to face an outer periphery of a rotor on a cam shaft for detection of cam angles, wherein a mounting portion is integrally formed with the cam angle sensor at a position outside of the head cover, the mounting portion of the cam angle sensor being fastened to a bearing cap by a fixing member penetrating through the head cover at a position adjacent to a position of the cam angle sensor, the bearing cap pivotally supporting the cam shaft at a position adjacent to a position of the rotor, wherein the fixing member includes a bolt fastening the mounting portion to the bearing cap, and a metal collar fitted around the bolt, the collar being arranged to abut both a lower face of the mounting portion and an upper face of the bearing cap, wherein the collar is arranged to form a clearance between the lower face of the mounting portion and an upper face of the head cover when the bolt is fastened.

* * * * *